US006548472B1

(12) United States Patent
Drapier et al.

(10) Patent No.: US 6,548,472 B1
(45) Date of Patent: Apr. 15, 2003

(54) LIQUID CLEANING COMPOSITIONS COMPRISING 2-BROMO-2-NITRO-1,3 PROPANEDIOL

(75) Inventors: Julien Drapier, Seraing (BE); Francoise Siquet-Descans, Faimes (BE); Maria Galvez, Saive (BE)

(73) Assignee: Colgate-Palmolive Co., Piscataway, NJ (US)

( * ) Notice: Subject to any disclaimer, the term of this patent is extended or adjusted under 35 U.S.C. 154(b) by 0 days.

(21) Appl. No.: 10/224,816

(22) Filed: Aug. 21, 2002

Related U.S. Application Data

(63) Continuation-in-part of application No. 09/933,986, filed on Aug. 21, 2001.

(51) Int. Cl.[7] ..... C11D 17/00

(52) U.S. Cl. ..... 510/424; 510/426; 510/477; 510/488; 510/499; 510/503; 510/505

(58) Field of Search ..... 510/424, 426, 510/477, 488, 499, 503, 505

(56) References Cited

U.S. PATENT DOCUMENTS 3,963,649 A * 6/1976 Spandini et al. ..... 252/546
3,983,079 A * 9/1976 Spandini et al. ..... 252/545
4,368,146 A * 1/1983 Aronson et al. ..... 252/542

* cited by examiner

*Primary Examiner*—Necholus Ogden
(74) *Attorney, Agent, or Firm*—Richard E. Nanfeldt

(57) ABSTRACT

A cleaning composition with desirable cleansing properties to the human skin comprising at least one surfactant, a preservative system and water.

6 Claims, 1 Drawing Sheet

Fig 1: Bacteria detection time versus sampling time
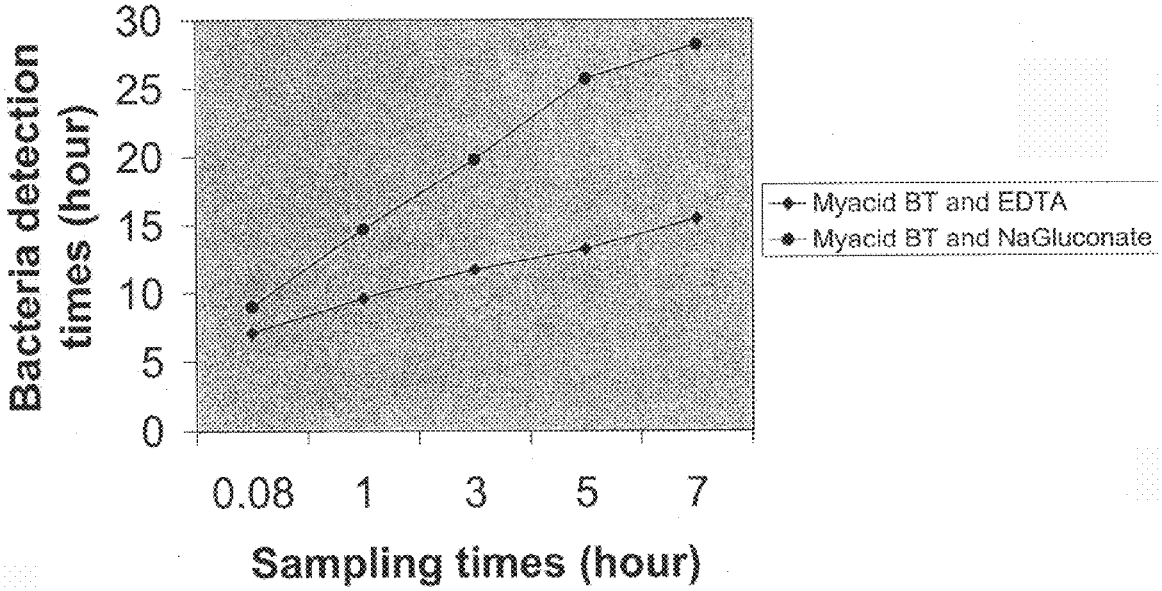

LIQUID CLEANING COMPOSITIONS COMPRISING 2-BROMO-2-NITRO-1,3 PROPANEDIOL

RELATED APPLICATION

This application is a continuation in part application of U.S. Ser. No. 9/933,986 filed Aug. 21, 2001 pending.

FIELD OF INVENTION

This invention relates to light duty or hard surface liquid cleaning compositions which have improved resistance to bacteria and which imparts mildness to the skin which are effective in removing particular and grease soil in leaving unrinsed surfaces with a shiny appearance.

BACKGROUND OF THE INVENTION

In recent years all-purpose light duty liquid or hard surface cleaning compositions have become widely accepted for cleaning hard surfaces, e.g., dishes, glasses, sinks, painted woodwork and panels, tiled walls, wash bowls, washable wall paper, etc. Such all-purpose liquids comprise clear and opaque aqueous mixtures of water-soluble organic detergents and water-soluble detergent builder salts.

The present invention relates to light duty liquid detergent compositions with high foaming properties, which contain a sulfonate surfactant and an alcohol ethoxysulfate.

The prior art is replete with light duty liquid detergent compositions containing nonionic surfactants in combination with anionic and/or betaine surfactants wherein the nonionic detergent is not the major active surfactant, as shown in U.S. Pat. No. 3,658,985 wherein an anionic based shampoo contains a minor amount of a fatty acid alkanolamide. U.S. Pat. No. 3,769,398 discloses a betaine-based shampoo containing minor amounts of nonionic surfactants. This patent states that the low foaming properties of nonionic detergents renders its use in shampoo compositions non-preferred. U.S. Pat. No. 4,329,335 also discloses a shampoo containing a betaine surfactant as the major ingredient and minor amounts of a nonionic surfactant and of a fatty acid mono- or di-ethanolamide. U.S. Pat. No. 4,259,204 discloses a shampoo comprising 0.8–20% by weight of an anionic phosphoric acid ester and one additional surfactant which may be either anionic, amphoteric, or nonionic. U.S. Pat. No. 4,329,334 discloses an anionic-amphoteric based shampoo containing a major amount of anionic surfactant and lesser amounts of a betaine and nonionic surfactants.

U.S. Pat. No. 3,935,129 discloses a liquid cleaning composition based on the alkali metal silicate content and containing five basic ingredients, namely, urea, glycerin, triethanolamine, an anionic detergent and a nonionic detergent. The silicate content determines the amount of anionic and/or nonionic detergent in the liquid cleaning composition. However, the foaming property of these detergent compositions is not discussed therein.

U.S. Pat. No. 4,129,515 discloses a heavy duty liquid detergent for laundering fabrics comprising a mixture of substantially equal amounts of anionic and nonionic surfactants, alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric ester salt of an ethylene oxide adduct of a secondary alcohol, and an amphoteric surfactant which may be a betaine, wherein either the anionic or nonionic surfactant may be the major ingredient.

SUMMARY OF THE INVENTION

It has now been found that a light duty or hard surface liquid cleaning composition can be formulated with at least one surfactant, 2-bromo-2-nitro-1,3 propanediol and sodium gluconate, wherein the composition which has desirable cleaning properties and mildness to the human skin as well as having improved resistance to bacteria.

An object of this invention is to provide a liquid cleaning composition which comprises at least one surfactant, and a preservative system comprising a mixture of 2-bromo-2-nitro-1,3 propanediol (Myacid BT) and sodium gluconate, wherein the instant compositions do not contain ethylene diamine tetraacetic acid or its sodium salts, choline chloride or buffering system which is a nitrogenious buffer which is ammonium or alkaline earth carbonate, guanidine derivates, alkoxylalkyl amines and alkyleneamines $C_3$–$C_7$ alkyl and alkenyl monobasic and dibasic acids such as $C_4$–$C_7$ aliphatic carboxylic diacids which do not contain a hydroxy group, phosphoric acid, amino alkylene phosphonic acid and the composition is pourable and is not a gel.

An object of the instant invention is to improve preservation. Although a preservative such as Myacid BT helps in preservation, a preservation potentiator enhances the preservation of bacteria. The preservation potentiator used in the instant composition complexes with the divalent magnesium and calcium metallic ions in the cleaning composition thereby destroying the integrity of the gram-negative bacterial external layer because these divalent metallic ions stabilize the external layers of the bacterial cells.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWING

FIG. 1 illustrates a graph of bacteria growth detection time versus sampling times for two preservative potentiators used in a light duty liquid composition.

DETAILED DESCRIPTION OF THE INVENTION

The present invention relates to a cleaning composition which comprises approximately by weight:

(a) 0.5% to 70%, more preferably 2% to 60% of at least one surfactant selected from the group consisting of anionic surfactants, zwitterionic surfactant, alkyl polyglucoside surfactants, amine oxide surfactants, $C_8$–$C_{15}$ fatty acid surfactants and ethoxylated and/or propoxylated nonionic surfactants and mixtures thereof;

(b) 0.005% to 0.5% of a preservative such as 2-bromo-2-nitro-1,3 propanediol;

(c) 0.005% to 0.5% of preservative potentiator such as sodium gluconate; and (d) the balance being water.

The light duty liquid compositions of the instant invention comprise approximately by weight:

(a) 6% to 30%, more preferably 8% to 26% of an alkali or alkaline earth metal salt of an anionic sulfonate surfactant;

(b) 0.5% to 12%, more preferably 1% to 10% of a $C_8$–$C_{18}$ ethoxylated alkylether sulfate;

(c) 0 to 20%, more preferably 0.1% to 20% of at least one other surfactant selected from the group consisting of alkyl polyglucoside surfactants, zwitterionic surfactants, ethoxylated and/or propoxylated nonionic surfactants, amine oxides and $C_8$–$C_{15}$ fatty acid monoalkanol amides and mixtures thereof;

(d) 0 to 5%, more preferably 0.1% to 3% of polyethylene glycol;

(e) 0 to 5%, more preferably 0.1% to 4% of an inorganic magnesium salt;

(f) 0.005% to 0.5% of 2-bromo-2-nitro-1,3 propanediol preservative;

(g) 0.005% to 0.5% of a preservative potentiator such as sodium gluconate; and (h) the balance being water.

The hard surface liquid cleaning compositions of the instant invention comprise approximately by weight:

(a) 0.5% to 40% of at least one surfactant selected from the group consisting of an alkali metal or alkaline earth metal salt of a sulfonate surfactant, an ethoxylated and/or propoxylated nonionic surfactant, a $C_8$–$C_{18}$ ethoxylated alkyl ether sulfate surfactant, an alkyl polyglucoside surfactant, a zwitterionic surfactant, amine oxides and $C_8$–$C_{15}$ fatty acid monoalkanol amides and mixtures thereof.

(b) 0 to 5%, more preferably 0.1% to 3% of polyethylene glycol;

(c) 0 to 5%, more preferably 0.1 % to 4% of an inorganic magnesium salt;

(d) 0.005% to 0.5% of 2-bromo-2-nitro-1,3 propanediol preservative;

(e) 0.005% to 0.5% of a preservative potentiator such as sodium gluconate; and (f) the balance being water.

The instant cleaning, light duty or hard surface cleaning compositions do not contain choline chloride or buffering system which is a nitrogenious buffer which is ammonium or alkaline earth carbonate, guanidine derivates, alkoxylalkyl amines and alkyleneamines $C_3$–$C_7$ alkyl and alkenyl monobasic and dibasic acids such as $C_4$–$C_7$ aliphatic carboxylic diacids which do not contain a hydroxy group, phosphoric acid, amino alkylene phosphonic acid and the composition is pourable and is not a gel.

The anionic sulfonate surfactants which may be used in the detergent of this invention are water soluble and include the sodium, potassium, ammonium and ethanolammonium salts of linear $C_8$–$C_{16}$ alkyl benzene sulfonates; $C_{10}$–$C_{20}$ paraffin sulfonates, alpha olefin sulfonates containing about 10–24 carbon atoms and $C_8$–$C_{18}$ alkyl sulfates and mixtures thereof. The preferred anionic sulfonate surfactant is a $C_{12-18}$ paraffin sulfonate.

The paraffin sulfonates may be monosulfonates or di-sulfonates and usually are mixtures thereof, obtained by sulfonating paraffins of 10 to 20 carbon atoms. Preferred paraffin sulfonates are those of $C_{12-18}$ carbon atoms chains, and more preferably they are of $C_{14-17}$ chains. Paraffin sulfonates that have the sulfonate group(s) distributed along the paraffin chain are described in U.S. Pat. Nos. 2,503,280; 2,507,088; 3,260,744; and 3,372,188; and also in German Patent 735,096. Such compounds may be made to specifications and desirably the content of paraffin sulfonates outside the $C_{14-17}$ range will be minor and will be minimized, as will be any contents of di- or poly-sulfonates.

Examples of suitable other sulfonated anionic detergents are the well known higher alkyl mononuclear aromatic sulfonates, such as the higher alkylbenzene sulfonates containing 9 to 18 or preferably 9 to 16 carbon atoms in the higher alkyl group in a straight or branched chain, or $C_{8-15}$ alkyl toluene sulfonates. A preferred alkylbenzene sulfonate is a linear alkylbenzene sulfonate having a higher content of 3-phenyl (or higher) isomers and a correspondingly lower content (well below 50%) of 2-phenyl (or lower) isomers, such as those sulfonates wherein the benzene ring is attached mostly at the 3 or higher (for example 4, 5, 6 or 7) position of the alkyl group and the content of the isomers in which the benzene ring is attached in the 2 or 1 position is correspondingly low. Preferred materials are set forth in U.S. Pat. No. 3,320,174, especially those in which the alkyls are of 10 to 13 carbon atoms.

The $C_{8-18}$ ethoxylated alkyl ether sulfate surfactants or alkyl sulfate surfactants are used at a concentration of 2 to 16 wt. %, more preferably 4 to 14 wt. %. The $C_8$–$C_{18}$ alkyl ether sulfate surfactants have the structure $$R—(OCHCH_2)_nOSO_3^{-M+}$$

wherein n is about 1 to about 22 more preferably 1 to 3 and R is an alkyl group having about 8 to about 18 carbon atoms, more preferably 12 to 15 and natural cuts, for example, $C_{12-14}$ or $C_{12-16}$ and M is an ammonium cation or a metal cation, most preferably sodium.

The ethoxylated alkyl ether sulfate may be made by sulfating the condensation product of ethylene oxide and $C_{8-10}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether polyethenoxy sulfates contain 12 to 20 carbon atoms in the alcohols and in the alkyl groups thereof, e.g., sodium myristyl (3 EO) sulfate.

Ethoxylated $C_{8-18}$ alkylphenyl ether sulfates containing from 2 to 6 moles of ethylene oxide in the molecule are also suitable for use in the invention compositions. These detergents can be prepared by reacting an alkyl phenol with 2 to 6 moles of ethylene oxide and sulfating and neutralizing the resultant ethoxylated alkylphenol. The concentration of the ethoxylated alkyl ether sulfate surfactant is about 2 to about 16 wt. %

The water soluble nonionic surfactants utilized in this invention are commercially well known and include the primary aliphatic alcohol ethoxylates, secondary aliphatic alcohol ethoxylates, alkylphenol ethoxylates and ethylene-oxide-propylene oxide condensates on primary alkanols, such a Plurafacs (BASF) and condensates of ethylene oxide with sorbitan fatty acid esters such as the Tweens (ICI). The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen or the oxygen can be condensed with ethylene oxide or with the polyhydration product thereof, polyethylene glycol, to form a water-soluble nonionic detergent. Further, the length of the polyethenoxy chain can be adjusted to achieve the desired balance between the hydrophobic and hydrophilic elements.

The nonionic detergent class includes the condensation products of a higher alcohol (e.g., an alkanol containing 8 to 18 carbon atoms in a straight or branched chain configuration) condensed with 5 to 30 moles of ethylene oxide, for example, lauryl or myristyl alcohol condensed with 16 moles of ethylene oxide (EO), tridecanol condensed with 6 to moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to 14 carbon atoms in length and wherein the condensate contains either 6 moles of EO per mole of total alcohol or 9 moles of EO per mole of alcohol and tallow alcohol ethoxylates containing 6 EO to 11 EO per mole of alcohol.

A preferred group of the foregoing nonionic surfactants are the Neodol ethoxylates (Shell Co.), which are higher aliphatic, primary alcohols containing about 9–15 carbon atoms, such as $C_9$–$C_{11}$ alkanol condensed with 8 moles of ethylene oxide (Neodol 91–8), $C_{12-13}$ alkanol condensed with 6.5 moles ethylene oxide (Neodol 23-6.5), $C_{12-15}$ alkanol condensed with 12 moles ethylene oxide (Neodol 25-12), $C_{14-15}$ alkanol condensed with 13 moles ethylene oxide (Neodol 45–13), and the like. Such ethoxamers have an HLB (hydrophobic lipophilic balance) value of 8–15 and give good oil in water emulsification, whereas ethoxamers with HLB values below 8 contain less than 5 ethyleneoxy groups and tend to be poor emulsifiers and poor detergents.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$–$C_{15}$ secondary alkanol condensed with either 9 EO (Tergitol 15-S-9) or 12 EO (Tergitol 15-S-12) marketed by Union Carbide.

Other suitable nonionic detergents include the polyethylene oxide condensates of one mole of alkyl phenol containing from 8 to 18 carbon atoms in a straight- or branched chain alkyl group with 5 to 30 moles of ethylene oxide. Specific examples of alkyl phenol ethoxylates include nonyl condensed with 9.5 moles of EO per mole of nonyl phenol, dinonyl phenol condensed with 12 moles of EO per mole of phenol, dinonyl phenol condensed with 15 moles of EO per mole of phenol and di-isoctylphenol condensed with 15 moles of EO per mole of phenol. Commercially available nonionic surfactants of this type include Igepal CO-630 (nonyl phenol ethoxylate) marketed by GAF Corporation.

Also among the satisfactory nonionic detergents are the water-soluble condensation products of a $C_8$–$C_{20}$ alkanol with a heteric mixture of ethylene oxide and propylene oxide wherein the weight ratio of ethylene oxide to propylene oxide is from 2.5:1 to 4:1, preferably 2.8:1–3.3:1, with the total of the ethylene oxide and propylene oxide (including the terminal ethanol or propanol group) being from 60–85%, preferably 70–80%, by weight. Such detergents are commercially available from BASF-Wyandotte and a particularly preferred detergent is a $C_{10}$–$C_{16}$ alkanol condensate with ethylene oxide and propylene oxide, the weight ratio of ethylene oxide to propylene oxide being 3:1 and the total alkoxy content being 75% by weight.

Other suitable water-soluble nonionic detergents which are less preferred are marketed under the trade name "Pluronics." The compounds are formed by condensing ethylene oxide with a hydrophobic base formed by the condensation of propylene oxide with propylene glycol. The molecular weight of the hydrophobic portion of the molecule is of the order of 950 to 4000 and preferably 200 to 2,500. The addition of polyoxyethylene radicals to the hydrophobic portion tends to increase the solubility of the molecule as a whole so as to make the surfactant water-soluble. The molecular weight of the block polymers varies from 1,000 to 15,000 and the polyethylene oxide content may comprise 20% to 80% by weight. Preferably, these surfactants will be in liquid form and satisfactory surfactants are available as grades L62 and L64.

The zwitterionic surfactant which can be used in the instant composition is a water soluble betaine having the general formula:

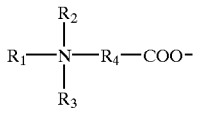

wherein $R_1$ is an alkyl group having 10 to 20 carbon atoms, preferably 12 to 16 carbon atoms, or the amido radical:

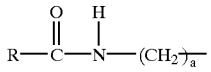

wherein R is an alkyl group having 9 to 19 carbon atoms and a is the integer 1 to 4; $R_2$ and $R_3$ are each alkyl groups having 1 to 3 carbons and preferably 1 carbon; $R_4$ is an alkylene or hydroxyalkylene group having from 1 to 4 carbon atoms and, optionally, one hydroxyl group. Typical alkyldimethyl betaines include decyl dimethyl betaine or 2-(N-decyl-N, N-dimethyl-ammonia) acetate, coco dimethyl betaine or 2-(N-coco N, N-dimethylammonio) acetate, myristyl dimethyl betaine, palmityl dimethyl betaine, lauryl diemethyl betaine, cetyl dimethyl betaine, stearyl dimethyl betaine, etc. The amidobetaines similarly include cocoamidoethylbetaine, cocoamidopropyl betaine and the like. A preferred betaine is coco ($C_8$–$C_{18}$) amidopropyl dimethyl betaine.

Amine oxide semi-polar nonionic surfactants comprise compounds and mixtures of compounds having the formula

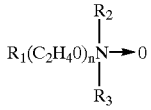

wherein $R_1$ is an alkyl, 2-hydroxyalkyl, 3-hydroxyalkyl, or 3-alkoxy-2-hydroxypropyl radical in which the alkyl and alkoxy, respectively, contain from 8 to 18 carbon atoms, $R_2$ and $R_3$ are each methyl, ethyl, propyl, isopropyl, 2-hydroxyethyl, 2-hydroxypropyl, or 3-hydroxypropyl, and n is from 0 to 10. Particularly preferred are amine oxides of the formula:

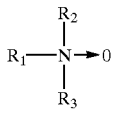

wherein $R_1$ is a $C_{12-16}$ alkyl or the amido radical:

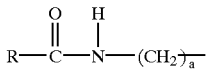

wherein R is an alkyl group having 9 to 19 carbon atoms and a is integer 1 to 4, and $R_2$ and $R_3$ are methyl or ethyl. The above ethylene oxide condensates, amides, and amine oxides are more fully described in U.S. Pat. No. 4,316,824 which is hereby incorporated herein by reference.

The alkyl polysaccharides surfactants, which are used in conjunction with the aforementioned surfactant have a hydrophobic group containing from about 8 to about 20 carbon atoms, preferably from about 10 to about 16 carbon atoms, most preferably from about 12 to about 14 carbon atoms, and polysaccharide hydrophilic group containing from about 1.5 to about 10, preferably from about 1.5 to about 4, most preferably from about 1.6 to about 2.7 saccharide units (e.g., galactoside, glucoside, fructoside, glucosyl, fructosyl; and/or galactosyl units). Mixtures of saccharide moieties may be used in the alkyl polysaccharide surfactants. The number x indicates the number of saccharide units in a particular alkyl polysaccharide surfactant. For a particular alkyl polysaccharide molecule x can only assume integral values. In any physical sample of alkyl polysaccharide surfactants there will be in general molecules having different x values. The physical sample can be characterized by the average value of x and this average value can assume non-integral values. In this specification the values of x are to be understood to be average values. The hydrophobic group (R) can be attached at the 2-, 3-, or 4-positions rather than at the 1-position, (thus giving e.g. a glucosyl or galactosyl as opposed to a glucoside or galactoside). However, attachment through the 1-position, i.e., glucosides, galactoside, fructosides, etc., is preferred. In the preferred product the additional saccharide units are predominately attached to the previous saccharide unit's 2-position. Attachment through the 3-, 4-, and 6-positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from about 8 to about 20, preferably from about 10 to about 18 carbon atoms. Preferably, the alkyl group is a straight chain saturated alkyl group. The alkyl group can contain up to 3 hydroxy groups and/or the polyalkoxide chain can contain up to about 30, preferably less than about 10, alkoxide moieties.

Suitable alkyl polysaccharides are decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkyl polysaccharides. When used in admixture with alkyl polysaccharides, the alkyl monosaccharides are solubilized to some extent. The use of alkyl monosaccharides in admixture with alkyl polysaccharides is a preferred mode of carrying out the invention. Suitable mixtures include coconut alkyl, di-, tri-, tetra-, and pentaglucosides and tallow alkyl tetra-, penta-, and hexaglucosides.

The preferred alkyl polysaccharides are alkyl polyglucosides having the formula $$R_2O(C_nH_{2n}O)_r(Z)_x$$

wherein Z is derived from glucose, R2 is a hydrophobic group selected from the group consisting of alkyl, alkylphenyl, hydroxyalkylphenyl, and mixtures thereof in which said alkyl groups contain from about 10 to about 18, preferably from about 12 to about 14 carbon atoms; n is 2 or 3 preferably 2, r is from 0 to 10, preferable 0; and x is from 1.5 to 8, preferably from 1.5 to 4, most preferably from 1.6 to 2.7. To prepare these compounds a long chain alcohol ($R_2OH$) can be reacted with glucose, in the presence of an acid catalyst to form the desired glucoside. Alternatively the alkyl polyglucosides can be prepared by a two step procedure in which a short chain alcohol ($R_1OH$) can be reacted with glucose, in the presence of an acid catalyst to form the desired glucoside. Alternatively the alkyl polyglucosides can be prepared by a two step procedure in which a short chain alcohol ($C_{1-6}$) is reacted with glucose or a polyglucoside (x=2 to 4) to yield a short chain alkyl glucoside (x=1 to 4) which can in turn be reacted with a longer chain alcohol ($R_2OH$) to displace the short chain alcohol and obtain the desired alkyl polyglucoside. If this two step procedure is used, the short chain alkylglucosde content of the final alkyl polyglucoside material should be less than 50%, preferably less than 10%, more preferably less than about 5%, most preferably 0% of the alkyl polyglucoside.

The amount of unreacted alcohol (the free fatty alcohol content) in the desired alkyl polysaccharide surfactant is preferably less than about 2%, more preferably less than about 0.5% by weight of the total of the alkyl polysaccharide. For some uses it is desirable to have the alkyl monosaccharide content less than about 10%.

The used herein, "alkyl polysaccharide surfactant" is intended to represent both the preferred glucose and galactose derived surfactants and the less preferred alkyl polysaccharide surfactants. Throughout this specification, "alkyl polyglucoside" is used to include alkyl polyglycosides because the stereochemistry of the saccharide moiety is changed during the preparation reaction.

An especially preferred APG glycoside surfactant is APG 625 glycoside manufactured by the Henkel Corporation of Ambler, Pa. APG25 is a nonionic alkyl polyglycoside characterized by the formula:

$$C_nH_{2n+1}O(C_6H_{10}O_5)_xH$$

wherein n=10 (2%); n=12 (65%); n=14 (21–28%); n=16 (4–8%) and n=18 (0.5%) and x (degree of polymerization)= 1.6. APG 625 has: a pH of 6 to 10 (10% of APG 625 in distilled water); a specific gravity at 25° C. of 1.1 g/ml; a density at 25° C. of 9.1 lbs/gallon; a calculated HLB of 12.1 and a Brookfield viscosity at 35° C., 21 spindle, 5–10 RPM of 3,000 to 7,000 cps.

The composition can contain 0 to 8 wt. %, more preferably 0.5 wt. % to 6 wt. % of a short chain amphiphile which is characterized by the formula:

$$R_1O—(CH_2CH_2O)_nH$$

wherein $R_1$ is a straight or branched chain alkyl group having 5 to 8 carbon atoms and n is a number from 2 to 8, more preferably 5 to 6 and the amphiphile has an HLB of about 6 to about 9, preferably about 7 to about 8. Preferred amphiphiles have a $C_6$ alkyl group and 2 to 5 EO such as hexanol 5EO.

The water soluble cosurfactant which can be used in total or partial replacement of the short chain amphiphile can play an essential role in the formation of the compositions. Suitable cosurfactants for over temperature ranges extending from 5° C. to 43° C. are water-soluble $C_3$–$C_4$ alkanols, polypropylene glycol of the formula $HO(CH_3CHCH_2O)_nH$ wherein n is a number from 2 to 18 and monoalkyl ethers and esters of ethylene glycol and propylene glycol having the structural formulas $R(X)_nOH$ and $R_1(X)_nOH$ wherein R is $C_1$–$C_6$ alkyl, $R_1$ is $C_2$–$C_4$ acyl group, X is $(OCH_2CH_2)$ or $(OCH_2(CH_3)CH)$ and n is a number from 1 to 4.

Representative members of the polypropylene glycol include dipropylene glycol and polypropylene glycol having a molecular weight of 200 to 1000, e.g., polypropylene glycol 400. Other satisfactory glycol ethers are ethylene glycol monobutyl ether (butyl cellosolve), diethylene glycol monobutyl ether (butyl carbitol), triethylene glycol monobutyl ether, mono, di, tri propylene glycol monobutyl ether, tetraethylene glycol monobutyl ether, propylene glycol tertiary butyl ether, ethylene glycol monoacetate and dipropylene glycol propionate.

The composition also contains an inorganic or organic salt or oxide of a multivalent metal cation, particularly $Mg^{++}$. The metal salt or oxide provides several benefits including improved cleaning performance in dilute usage, particularly in soft water areas, and minimized amounts of perfume required to obtain the microemulsion state. Magnesium sulfate, either anhydrous or hydrated (e.g., heptahydrate), is especially preferred as the magnesium salt. Good results also have been obtained with magnesium oxide, magnesium chloride, magnesium acetate, magnesium propionate and magnesium hydroxide. These magnesium salts can be used with formulations at neutral or acidic pH since magnesium hydroxide will not precipitate at these pH levels.

Although magnesium is the preferred multivalent metal from which the salts (inclusive of the oxide and hydroxide) are formed, other polyvalent metal ions also can be used provided that their salts are nontoxic and are soluble in the aqueous phase of the system at the desired pH level.

The instant composition can contain from 0 to 8 wt. %, more preferably 0.1 wt. % to 6 wt. % of a water insoluble organic compound which can be provided by a non-water-soluble perfume, essential oil, water insoluble organic ester or water insoluble hydrocarbon having 6 to 18 carbon atoms. Typically, in aqueous based compositions the presence of a solubilizers, such as alkali metal lower alkyl aryl sulfonate hydrotrope, triethanolamine, urea, etc., is required for perfume dissolution, especially at perfume levels of 1% and higher, since perfumes are generally a mixture of fragrant essential oils and aromatic compounds which are generally not water-soluble. Therefore, by incorporating the perfume into the aqueous cleaning composition as the oil (hydrocarbon) phase of the ultimate o/w microemulsion composition, several different important advantages are achieved.

As used herein and in the appended claims the term "perfume" is used in its ordinary sense to refer to and include any non-water soluble fragrant substance or mixture of substances including natural (i.e., obtained by extraction of flower, herb, blossom or plant), artificial (i.e., mixture of natural oils or oil constituents) and synthetically produced substance) odoriferous substances. Typically, perfumes are complex mixtures of blends of various organic compounds such as alcohols, aldehydes, ethers, aromatic compounds and varying amounts of essential oils (e.g., terpenes) such as from 0% to 80%, usually from 10% to 70% by weight, the essential oils themselves being volatile odoriferous compounds and also serving to dissolve the other components of the perfume.

In the present invention the precise composition of the perfume is of no particular consequence to cleaning performance so long as it meets the criteria of water immiscibility and having a pleasing odor. Naturally, of course, especially for cleaning compositions intended for use in the home, the perfume, as well as all other ingredients, should be cosmetically acceptable, i.e., non-toxic, hypoallergenic, etc.

In place of the perfume in the microemulsion composition one can employ an essential oil or a water insoluble hydrocarbon having 6 to 18 carbon such as a paraffin or isoparaffin.

Suitable essential oils are selected from the group consisting of: Anethole 20/21 natural, Aniseed oil china star, Aniseed oil globe brand, Balsam (Peru), Basil oil (India), Black pepper oil, Black pepper oleoresin 40/20, Bois de Rose (Brazil) FOB, Borneol Flakes (China), Camphor oil, White, Camphor powder synthetic technical, Cananga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Coumarin 69° C. (China), Cyclamen Aldehyde, Diphenyl oxide, Ethyl vanilin, Eucalyptol, Eucalyptus oil, Eucalyptus citriodora, Fennel oil, Geranium oil, Ginger oil, Ginger oleoresin (India), White grapefruit oil, Guaiacwood oil, Gurjun balsam, Heliotropin, Isobornyl acetate, Isolongifolene, Juniper berry oil, L-methyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java), Wintergreen.

The water insoluble saturated organic diester has the formula:

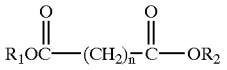

wherein $R_1$ and $R_2$ are independently a $C_2$ to $C_6$ alkyl group and n is a number from 4 to 8. A preferred organic diester is dibutyl adipate. The concentration of the organic diester in the microemulsion composition is about 0.5 wt. % to about 8 wt. %, more preferably about 1 wt. % to about 6 wt. %.

Among components of different types of perfumes that may be employed are the following: essential oils—pine, balsam, fir, citrus, evergreen, jasmine, lily, rose and ylang ylang; esters—phenoxyethyl isobutyrate, benzyl acetate, p-tertiary butyl cyclohexyl acetate, guaiacwood acetate, linalyl acetate, dimethylbenzyl carbinyl acetate, phenylethyl acetate, linalyl benzoate, benzyl formate, ethylmethylphenyl glycidate, allylcyclohexane propionate, styrallyl propionate and benzyl salicylate; ethers—benzyl-ethyl ether; aldehydes—alkyl aldehydes of 8 to 18 carbon atoms, bourgeonal, citral, citronellal, citronellyl oxyacetaldehyde, cyclamen aldehyde, hydroxycitronellal and lilial; alcohols—anethol, citronellol, eugenol, geraniol, linalool, phenylethyl alcohol and terpineol; hydrocarbons—balsams and terpenes; ketones—ionones, alpha-isomethyl ionone, and methylcedryl ketone; lactones—gamma-alkyl lactone wherein the alkyl is of 8 to 14 carbon atoms; pyrrones—hydroxy-lower alkyl pyrrone wherein the alkyl is of 1 to 4 carbon toms; and pyrroles—benzopyrrole.

While various components of perfumes that are considered to be useful in the invented composition have been described above, the particular composition of the perfume is not considered to be critical with respect to cleaning properties so long as it is water insoluble (and has an acceptable fragrance). For use by the housewife or other consumer in the home, the perfume, as well as all other components of these cleaners, should be cosmetically acceptable, i.e., non-toxic, hypoallergenic, etc.

The polyethylene glycol used in the instant composition has a molecular weight of 200 to 1,000, wherein the polyethylene glycol has the structure $$HO(CH_2CH_2O)_nH$$

wherein n is 4 to 25.

To the composition can also be added water soluble hydrotropic salts including sodium, potassium, ammonium and mono-, di- and triethanolammonium salts. While the aqueous medium is primarily water, preferably said solubilizing agents are included in order to control the viscosity of the liquid composition and to control low temperature cloud clear properties. Usually, it is desirable to maintain clarity to a temperature in the range of 0° C. to 50° C. Therefore, the proportion of solubilizer generally will be from 1%–15%, preferably 2%–12%, most preferably 2%–8%, by weight of the detergent composition with the proportion of ethanol, when present, being 5% of weight or less in order to provide a composition having a flash point above 46° C. Preferably the solubilizing ingredient will be a mixture of ethanol and either sodium xylene sulfonate or sodium cumene sulfonate or a mixture of said sulfonates or ethanol and urea. Inorganic salts such as sodium sulfate, magnesium sulfate, sodium chloride and sodium citrate can be added at concentrations of 0.5 to 4.0 wt. % to modify the cloud point of the nonionic surfactant and thereby control the haze of the resultant solution. Various other ingredients such as urea at a concentration of 0.5 to 4.0 wt. % or urea at the same concentration in combination with ethanol at a concentration of 0.5 to 4.0 wt. % can be used as solubilizing agents. Other ingredients which have been added to the compositions at concentrations of 0.1 to 4.0 wt. percent are perfumes, sodium bisulfite, isoethanoeic acid and proteins such as lexine protein. The foregoing solubilizing ingredients also facilitate the manufacture of the inventive compositions because they tend to inhibit gel formation.

The instant formulas explicitly exclude alkali metal silicates and alkali metal builders such as alkali metal polyphosphates, alkali metal carbonates and alkali metal phosphonates because these materials, if used in the instant composition, would cause the composition to have a high pH as well as leaving residue on the surface being cleaned.

The final essential ingredient in the inventive compositions having improved interfacial tension properties is water. The proportion of water in the compositions generally is in the range of 35% to 90%, preferably 50% to 85% by weight of the usual diluted o/w microemulsion composition.

The liquid cleaning composition of this invention may, if desired, also contain other components either to provide additional effect or to make the product more attractive to the consumer. The following are mentioned by way of example: Colors or dyes in amounts up to 0.5% by weight; preservatives or antioxidizing agents, such as formalin, 5-bromo-5-nitro-dioxan-1,3,5-chloro-2-methyl-2H-isothiazole-3-one, 2,6-di-tert.butyl-p-cresol, etc., in amounts up to 2% by weight; and pH adjusting agents, such as sulfuric acid or sodium hydroxide, as needed. Furthermore, if opaque compositions are desired, up to 4% by weight of an opacifier may be added.

In final form, the instant compositions exhibit stability at reduced and increased temperatures. More specifically, such compositions remain clear and stable in the range of 0° C. to 50° C., especially 10° C. to 43° C. Such compositions exhibit a pH of 3 to 7.0. The liquid microemulsion compositions are readily pourable and exhibit a viscosity in the range of 6 to 400 millipascal second (mPas.) as measured at 25° C. with a Brookfield RVT Viscometer using a #2 spindle rotating at 50 RPM.

The following examples illustrate liquid cleaning compositions of the described invention. Unless otherwise specified, all percentages are by weight. The exemplified compositions are illustrative only and do not limit the scope of the invention. Unless otherwise specified, the proportions in the examples and elsewhere in the specification are by weight.

EXAMPLE 1

The following compositions in wt. % were prepared by simple mixing procedure:

| | A (Ref.) | B | C | D |
|---|---|---|---|---|
| $C_{14-17}$ Paraffin sulfonate sodium salt | 9.1 | 9.1 | 25 | 25 |
| $C_{12}$—AEOS 2:1 EO | 7.5 | 7.5 | 4 | 4 |
| Na4EDTA | 0.059 | — | 0.059 | — |
| Polyethylene glycol MN300 | 0.6 | 0.6 | 1 | 1 |
| Nonionic surfactant | — | — | 4.5 | 4.5 |
| MgSO4 7H2O | 1 | 1 | 1 | 1 |
| Sodium gluconate | — | 0.07 | — | 0.07 |
| 2-bromo-2-nitro-1,3 propanediol | 0.015 | 0.015 | 0.01 | 0.01 |
| Table salt | 2.5 | 2.5 | — | — |
| Perfume | 0.13 | 0.13 | 0.21 | 0.21 |
| Water | Bal. | Bal. | Bal. | Bal. |
| Appearance @ RT | clear | clear | clear | clear |
| Appearance @ 4C | clear | clear | clear | clear |
| pH | 6.0 | 6.0 | 6.0 | 6.0 |

FIG. 1 compares D bacteria values for formula A (reference) which uses Na4EDTA as a Myacid BT potentiator and formula B which uses sodium gluconate as Myacid BT potentiator. FIG. 1 clearly shows that sodium gluconate is a superior Myacid BT potentiator.

This D-value method test is used for rapid screening. It compares the new product to a reference which gives satisfactory result in real life conditions and which must have a formula composition as close as possible to the tested product (in this example EDTA has been replaced by sodium gluconate). The tested product and the reference are inoculated by a mixture of bacteria. Once they have been inoculated the bacteria slowly disappear due to the beneficial influence of the preservative system. The longer the contact time, the lower the residual bacteria number. The better the preservation system, the lower the residual bacteria number at a given time. The inocculated products are then sampled at different times and the samples are diluted by a nutriant which helps bacteria proliferation. The time needed to detect bacteria in the diluted sample is then measured by conductometry (bacteria growth generally leads to a increase of conductivity). The longer the detection time in sample diluted by nutrient, the lower the residual alive bacteria number after sampling, the better the preservative system. FIG. 1 clearly shows that whatever the sampling time residual bacteria colony number is always inferior in sample protected by myacid BT+gluconate (Formula B) versus sample preserved by myacid BT+EDTA (Formula A) and that the longer the sampling times the larger the difference between the 2 systems.

What is claimed:

1. A clear liquid cleaning composition which comprises approximately by weight:

(a) 0.5% to 40% of at least one surfactant selected from the group consisting of an alkali metal or alkaline earth metal salt of a sulfonate surfactant, an ethoxylated and/or propoxylated nonionic surfactant, a $C_8$–$C_{18}$ ethoxylated alkyl ether sulfate surfactant, an alkyl polyglucoside surfactant, a zwitterionic surfactant, amine oxides and $C_8$–$C_{15}$ fatty acid monoalkanol amides and mixtures thereof.

(b) 0.005% to 0.5% of 2-bromo-2-nitro-1,3 propanediol preservative;

(c) 0.005% to 0.5% of a preservative potentiator such as sodium gluconate; and (d) the balance being water wherein the compositions do not contain choline chloride or buffering system which is a nitrogenious buffer which is ammonium or alkaline earth carbonate, guanidine derivates, alkoxylakyl amines and alkyleneamines C3–C7 alkyl and alkenyl monobasic and dibasic acids such as C4–C7 aliphatic carboxylic diacids which do not contain hydroxy group, phosphoric acid, amino alkylene phosphonic acid and the composition is pourable and is not a gel.

2. The composition of claim 1, further including 0.1% to 3% of polyethylene glycol.

3. The composition of claim 1, further including 0.1% to 4% of an inorganic magnesium salt.

4. The composition of claim 2, further including 0.1% to 4% of an inorganic magnesium salt.

5. The composition of claim 1, further including 0.1% to 6% of a water insoluble organic compound.

6. The composition of claim 5, further including 0.5% to 6% of a short chain amphiphile having the formula $R_1O(CH_2CH_2O)_nH$ wherein $R_1$ is an alkyl group having 5 to 8 carbon atoms and n is a number from 2 to 8 and a water soluble glycol ether cosurfactant.

* * * * *